US006761471B2

(12) United States Patent
Wu

(10) Patent No.: US 6,761,471 B2
(45) Date of Patent: Jul. 13, 2004

(54) METHOD AND APPARATUS FOR RETROFITTING BACKLIT SIGNS WITH LIGHT EMITTING DIODE MODULES

(75) Inventor: Chen H. Wu, Los Altos Hills, CA (US)

(73) Assignee: Leotek Electronics Corporation, Santa Clara, CA (US)

( * ) Notice: Subject to any disclaimer, the term of this patent is extended or adjusted under 35 U.S.C. 154(b) by 0 days.

(21) Appl. No.: 10/452,672

(22) Filed: May 30, 2003

(65) Prior Publication Data

US 2004/0080960 A1 Apr. 29, 2004

Related U.S. Application Data

(60) Provisional application No. 60/417,211, filed on Oct. 8, 2002.

(51) Int. Cl.[7] ..... F21V 21/32

(52) U.S. Cl. ..... 362/250; 362/428; 362/240; 362/812; 362/800; 362/418; 362/396; 40/541; 40/544

(58) Field of Search ..... 362/555, 559, 362/800, 812, 545, 544, 240, 237, 238, 239, 233, 249, 20, 250, 418, 420, 433, 449, 372, 430, 428, 396; 40/570, 546, 541, 550, 572, 544

(56) References Cited

U.S. PATENT DOCUMENTS

| | | | | |
|---|---|---|---|---|
| 5,388,357 A | 2/1995 | Malita | ..... | 40/570 |
| 5,410,453 A | 4/1995 | Ruskouski | ..... | 362/20 |
| 5,416,679 A | 5/1995 | Ruskouski et al. | ..... | 362/240 |
| 5,428,912 A | 7/1995 | Grondal et al. | ..... | 40/570 |
| 5,459,955 A | 10/1995 | Ruskouski et al. | ..... | 40/570 |
| 5,526,236 A | 6/1996 | Burnes et al. | ..... | 362/20 |
| 5,688,042 A | 11/1997 | Madadi et al. | ..... | 362/240 |
| 5,949,347 A | 9/1999 | WU | ..... | 324/772 |
| 6,036,336 A | 3/2000 | Wu | ..... | 362/249 |
| 6,481,130 B1 | 11/2002 | Wu | ..... | 40/546 |
| 6,558,021 B2 | 5/2003 | Wu et al. | ..... | 362/249 |

*Primary Examiner*—Stephen Husar
*Assistant Examiner*—Bao Q. Truong
(74) *Attorney, Agent, or Firm*—Gray Cary Ware & Freidenrich LLP

(57) ABSTRACT

A method and apparatus for retrofitting a backlit sign with an LED module. The housing includes sidewalls with translucent portions. The LED module includes linear arrays of LEDs supported by support arms having mounting mechanisms for engaging with the housing sidewalls. The mounting mechanisms include scissor arms rotatably attached together about mid-portions thereof, and a tightening screw that adjusts the distance between the scissor arm ends to press engagement surfaces of the scissor arms against the housing sidewalls. Adjustment screws at the lower ends of the support arm can be adjusted to further extend the engagement surfaces, so that a single LED module can be installed inside a wide range of backlit sign sizes. The retrofit method includes removing the conventional fluorescent lamp from the backlit sign, and installing the LED module using the scissor arm mounting mechanisms.

32 Claims, 8 Drawing Sheets

METHOD AND APPARATUS FOR RETROFITTING BACKLIT SIGNS WITH LIGHT EMITTING DIODE MODULES

This application claims the benefit of U.S. Provisional Application No. 60/417,211, filed Oct. 8, 2002, and entitled Method And Apparatus For Retrofitting Commercial Signs and Street Name Signs With Light-Emitting Diode (LED) Modules.

FIELD OF THE INVENTION

The present invention relates to light emitting diode (LED) modules, and more particularly to a method and LED module for retrofitting existing commercial and street name signs presently illuminated with fluorescent tube lighting.

BACKGROUND OF THE INVENTION

Light emitting diodes (LEDs) have been widely used in many applications to replace conventional incandescent lamps, fluorescent lamps, neon tube lamps and fiber optic lights. LEDs consume much less electrical power, are far more reliable, and exhibit much longer lifetimes, than their conventional counterparts. As a result, LEDs have been configured to replace conventional light sources for many applications. For example, LED lamps have been developed to replace screw-in incandescent light bulbs for traffic signals (as shown in U.S. Pat. No. 6,036,336), and exit signs (as shown in U.S. Pat. Nos. 5,416,679, 5,459,955, 5,526,236, 5,688,042, 5,949,347). In each case, the LEDs arc mounted onto a lamp housing having a conventional threaded electrical connector that engages with the threaded socket connector in the traffic signal lamp or exit sign. Thus, retrofitting the traffic signal and exit signs simply involves unscrewing the conventional lamp and screwing in the LED lamp.

Retrofitting with LED lamps the vast numbers of backlit commercial and street name signs, which utilize fluorescent lighting, is more problematic. These signs typically include a housing containing one or more fluorescent tube lamps, and one or more translucent face plates (sidewalls) that are back-illuminated by the fluorescent lamp(s) (i.e. to form characters, designs, symbols, etc.). FIGS. 1A and 1B illustrate a conventional backlit street name sign, which includes a housing 1, a pair of fluorescent tube lamps 2 and a pair of opposing translucent face plates 3 that indicate a street name. Each of the fluorescent tube lamps 2 are connected to and suspended by a pair of electrical connectors 4, which are well known in the art. The face plates 3 are angled slightly downwardly for better viewing from below. FIGS. 2A and 2B illustrate a convention backlit commercial sign, where there is only a single translucent face plate 3 (which is not angled downwardly), and three fluorescent tube lamps 2 for illumination.

Replacing the short-lifespan fluorescent tube lamps in conventional backlit commercial and street name signs can be difficult, because such signs are typically elevated and inaccessible, disposed over roadways, and/or hard to open. What is worse is that there is no standard size for such signs, for the fluorescent tube lamps 2 used therein, and for the spacing between the electrical connectors 4. Thus, designing an LED lamp retrofit that fits a wide variety of such signs, that evenly and sufficiently illuminates such signs, and that is easy to install without the need for special tools, has been difficult. Adding to that difficulty is the fact that many such signs are suspended in a way that the sign rocks, vibrates and shakes in the wind.

There is a need for a versatile LED lamp design for retrofitting conventional backlit commercial and street name signs that is easy to install and fits in a variety of sign sizes and configurations.

SUMMARY OF THE INVENTION

The present invention solves the aforementioned problems by providing an LED lamp design and method for conveniently retrofitting conventional backlit signs.

The LED module of the present invention includes a first support member having a first mounting surface, a first plurality of LEDs mounted to the first mounting surface, first and second support arms attached to the first support member, a first mounting mechanism attached to the first support arm, and a second mounting mechanism attached to the second support arm. Each of the first and second mounting mechanisms include first and second scissor arms and a first screw. Each of the scissor arms have an upper portion, a lower portion and a mid portion therebetween, wherein the mid portions of the first and second scissor arms are rotatably connected together and each of the lower portions includes an engagement surface. The first screw is engaged with the first and second scissor arm upper portions for adjusting a distance therebetween and a separation distance between the engagement surfaces of the first and second scissor arm lower portions.

In another aspect of the present invention, a backlit sign includes a housing having first and second side walls with at least a portion of the first sidewall being translucent, a first support member disposed in the housing and having a first mounting surface facing the first sidewall, a first plurality of LEDs mounted to the first mounting surface for illuminating the first sidewall, first and second support arms attached to the first support member, a first mounting mechanism attached to the first support arm, and a second mounting mechanism attached to the second support arm. Each of the first and second mounting mechanisms include first and second scissor arms and a first screw. Each of the scissor arms have an upper portion, a lower portion and a mid portion therebetween, wherein the mid portions of the first and second scissor arms are rotatably connected together and each of the lower portions includes an engagement surface that is pressed against one of the first and second sidewalls to form a friction fit therewith. The first screw is engaged with the first and second scissor arm upper portions for adjusting a distance therebetween and a separation distance between the engagement surfaces of the first and second scissor arm lower portions to increase or decrease a force with which the engagement surfaces are pressed against the sidewalls.

Another aspect of the present invention is a method of retrofitting a backlit sign having a housing with first and second sidewalls, and a light source disposed inside a housing, wherein at least a portion of the first sidewall is translucent, the method including removing the light source from the housing, and inserting an LED module into the housing. The LED module includes a first support member disposed in the housing and having a first mounting surface, a first plurality of LEDs mounted to the first mounting surface for illuminating the first sidewall, first and second support arms attached to the first support member, a first mounting mechanism attached to the first support arm, and a second mounting mechanism attached to the second support arm. Each of the first and second mounting mechanisms include first and second scissor arms and a first screw. Each of the scissor arms have an upper portion, a lower portion and a mid portion therebetween, wherein the mid portions of the first and second scissor arms are rotatably connected together and each of the lower portions includes an engagement surface. The first screw is engaged with the first and second scissor arm upper portions for adjusting a distance therebetween and a separation distance between the engagement surfaces of the first and second scissor arm lower portions. The method also includes rotating the first screw to press the engagement surfaces against the first and second sidewalls to form a friction fit therewith for securing the LED module within the housing.

Other objects and features of the present invention will become apparent by a review of the specification, claims and appended figures.

DETAILED DESCRIPTION OF THE PREFERRED EMBODIMENTS

Figure 1A:
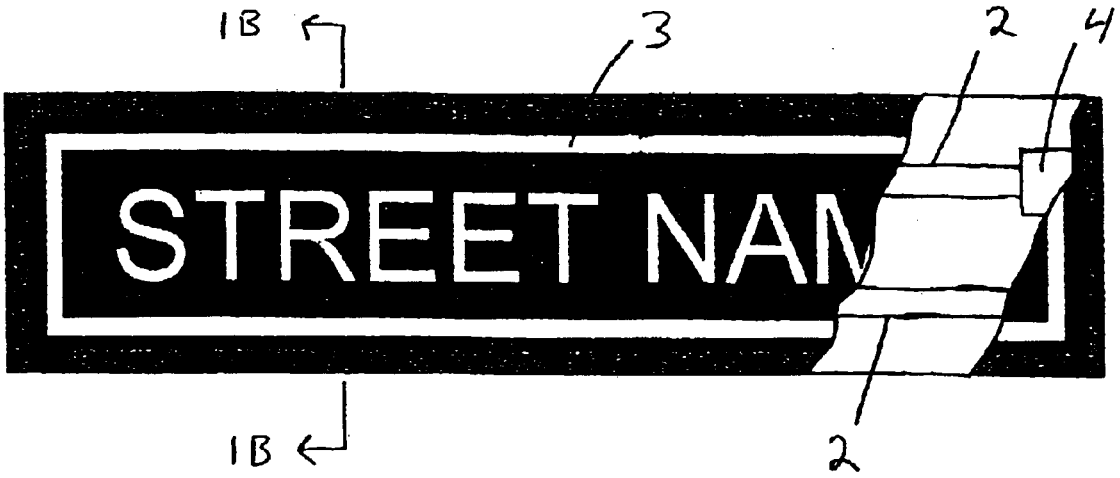
Fig 1A (Prior Art)
FIG. 1A is a partially broken away side view of a conventional backlit street name sign.

The present invention is an LED module that mounts in conventional backlit commercial and street name signs. The LED module 10 is illustrated in FIGS. 3A and 3B, and includes one or more LED arrays 12, a pair of side support arms 14, a pair of mounting mechanisms 16, and a power supply 18.

Figure 1B:
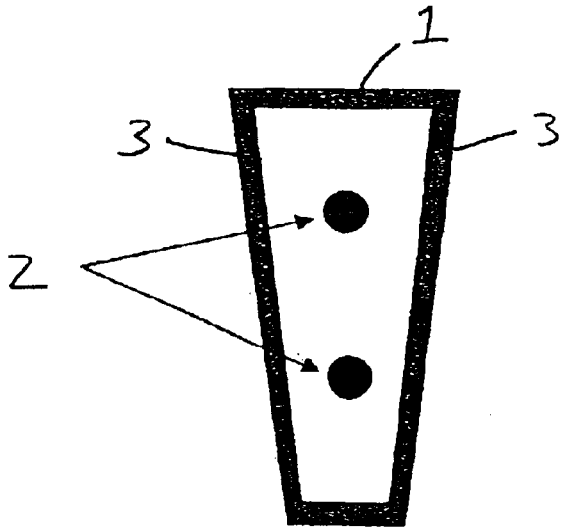
Fig 1B (Prior Art)
FIG. 1B is a side cross-section view of the conventional backlit street name sign taken along line 1B—1B in FIG. 1A.
Figure 2A:
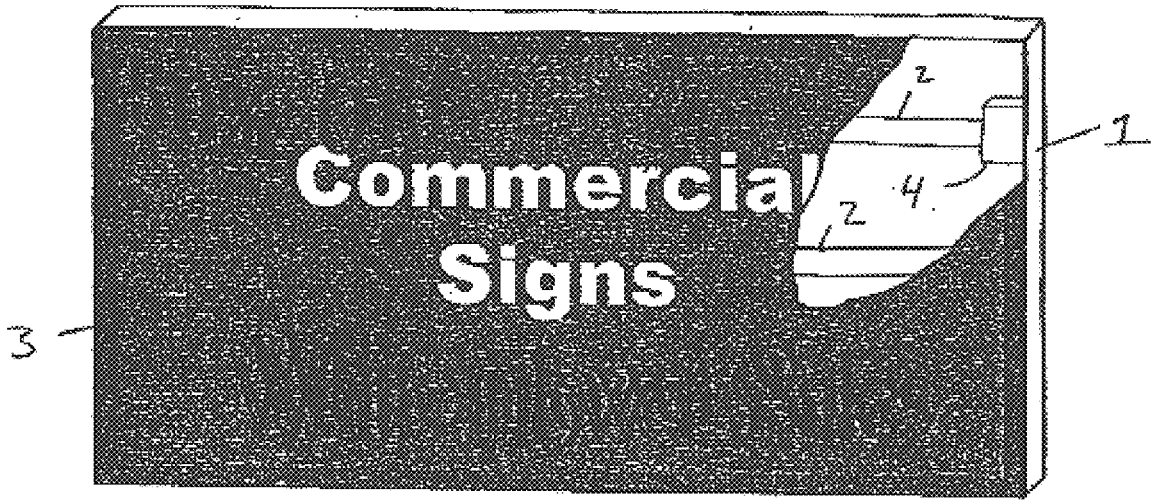
Fig 2A (Prior Art)
FIG. 2A is a partially broken away side view of a conventional backlit commercial sign.
Figure 2B:
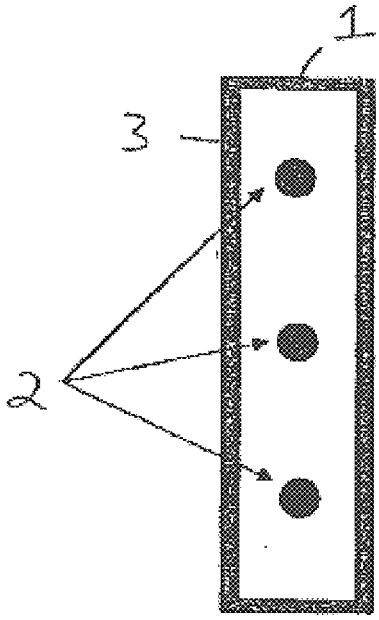
Fig 2B (Prior Art)
FIG. 2B is a side cross-section view of the conventional backlit commercial sign taken along line 2B—2B in FIG. 2A.

Each LED array 12 includes a support member 20 (which can act as a heat sink) having one or more mounting surfaces 22 on which a plurality of outward facing light emitting diodes (LEDs) 24 are mounted. If the LED module 10 is for use with a double sided sign (one having two opposing translucent plates), then the support member 20 preferably includes two mounting surfaces 22 on opposing sides of the support member 20, as shown in FIG. 3B. If the sign also has downwardly angled translucent plates (e.g. see FIG. 1B, where plates are not parallel to each other), then the mounting surfaces 22 can be downwardly angled (as shown in FIG. 3B, where surfaces 22 generally face in opposite directions but are not parallel to each other) so that LEDs 24 mounted thereon are directly facing the angled translucent plates (i.e. each mounting surface is parallel to the translucent plate it faces). The LEDs can be mounted on the mounting surfaces in any appropriate configuration, such as the linear configuration illustrated in FIG. 3A (i.e. a linear array of LEDs), where the LEDs provide a high output intensity and a wide viewing angle.

Figure 3A:
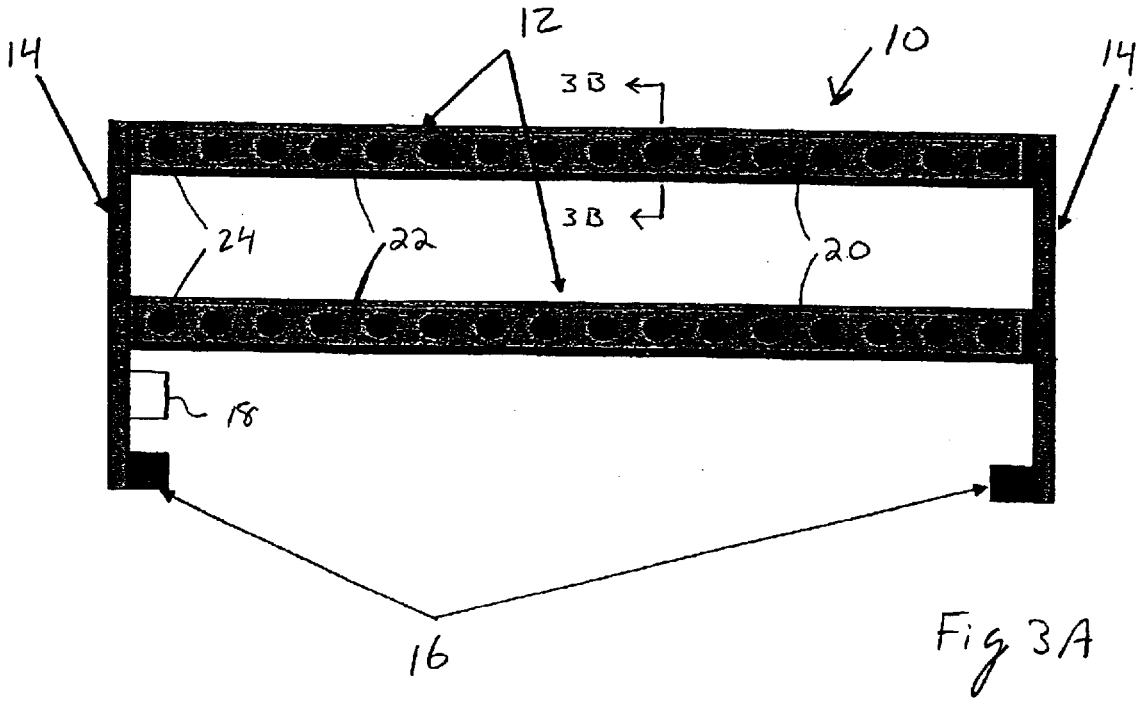
FIG. 3A is a side view of the LED module of the present invention.
Figure 3B:
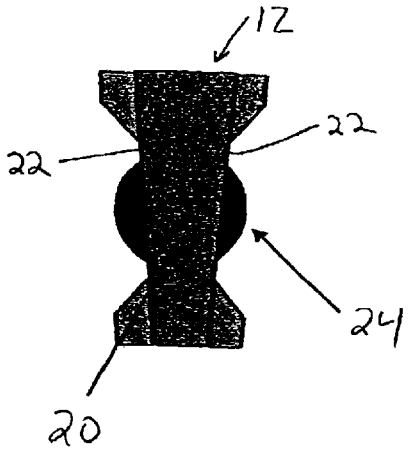
FIG. 3B is an end cross-section view of the LED array of the present invention, taken along line 3B—3B in FIG. 3A.

The support arms 14 are attached to and support the ends of the support members 20, as shown in FIG. 3A. Support arms 14 can be made of any rigid material, and preferably include electrical connections, wiring or conductive material or components to convey electrical power from the power supply 18 to the LEDs 24. The size of the LED module 10, as well as the number of LED arrays 12 and the number of LEDs 24 in each array, are selected to fit and properly illuminate the sign to be retrofitted.

Figure 4:
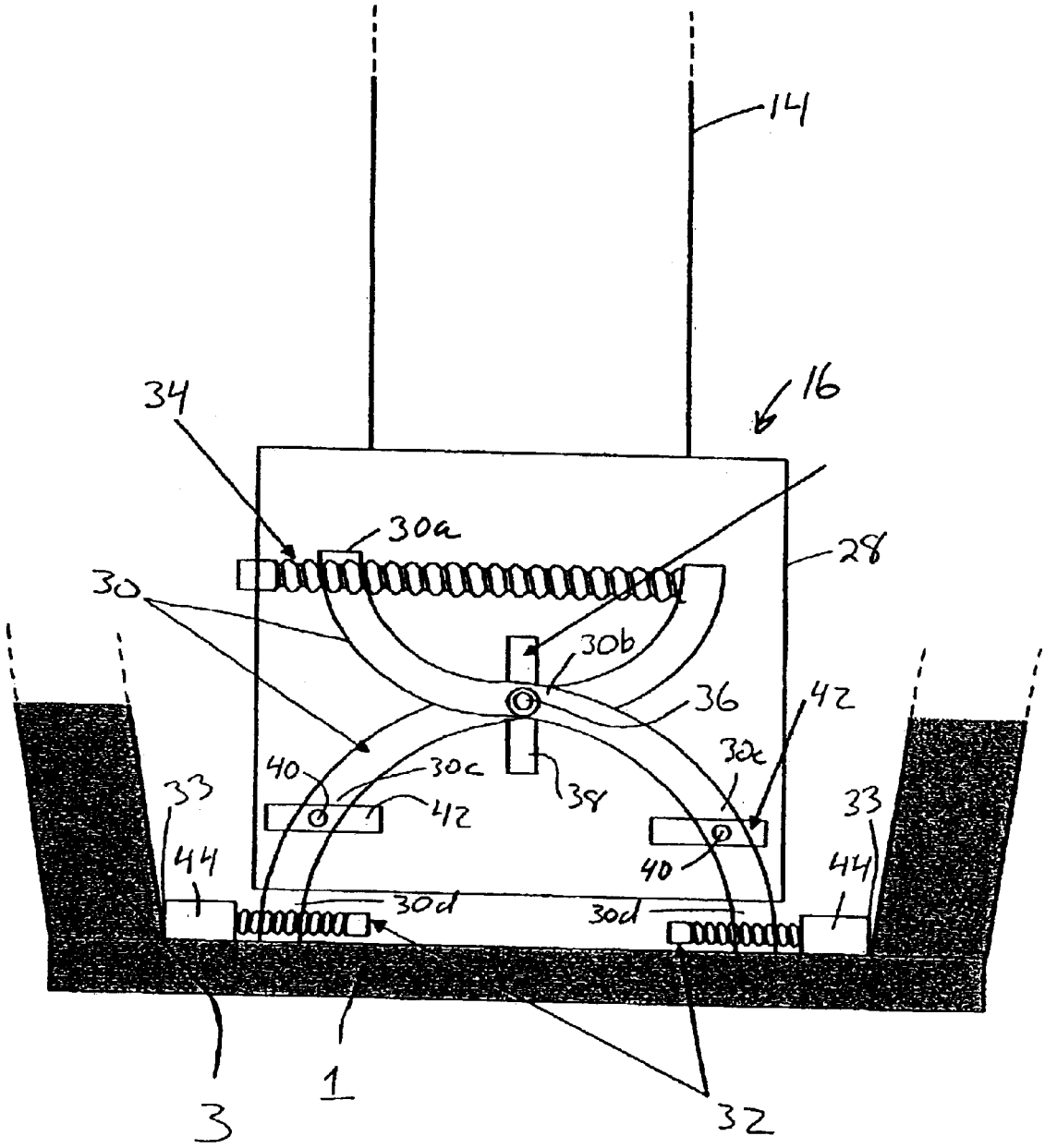
FIG. 4 is a side view of the mounting mechanism of the present invention.

The mounting mechanism 16 is best shown in FIG. 4, and includes a mounting member 28 either rigidly connected to or integrally formed as part of one of the support arms 14, a pair of scissor arms 30, a pair of adjustment screws 32, and a tightening screw 34. The scissor arms 30 are preferably S-shaped, and each includes an upper portion 30*a*, a mid-portion 30*b*, a lower mid portion 30*c*, and a lower portion 30*d*. The scissor arm mid portions 30*b* are rotatably connected together by a bolt 36 that extends through a vertical slot 38 formed in the mounting member 28. For each scissor arm 30, a bolt 40 extends from its lower mid-portion 30*c* and through a horizontal slot 42 formed in the mounting member 28. Each of the adjustment screws 32 is threaded through the lower portion 30*d* of one of the scissor arms 30, and terminates in an engagement surface 33. In the preferred embodiment, each adjustment screw 32 includes an engagement block of material 44 conducive to forming a friction fit (e.g. compressible or course materials, etc), with the engagement surface 33 at the end of the engagement block 44. The tightening screw 34 is threaded through one of the scissor arm upper portions 30*a*, and is rotatably engaged with the other scissor arm upper portion 30*a*. Each of the screws 32/34 includes a conventional adjustment end (Phillips, flat blade, Allen key, etc.) for rotation thereof, thus allowing the LED module 10 to be installed with no special tools (i.e. nothing more than just a screw driver or Allen key).

To retrofit a conventional backlit sign, its housing is opened and the fluorescent tube lamps therein are removed. The adjustment screws 32 of the LED module(s) to be inserted inside the sign are adjusted so that the engagement surfaces 33 for each pair of adjustment screws 32 are separated slightly less than the interior depth of the sign's housing at its base. After the LED module is placed inside the sign housing, each of the mounting mechanisms are operated by rotating its tightening screw 34 to separate the scissor arm upper portions 30*a* from each other, which also separates the lower portions 30*d* from each other as well, thus driving the engagement surfaces 33 away from each other and against the sign's sidewalls to form a secure friction fit therebetween. As the tightening screw 34 is adjusted, the bolts 36/40 slide in slots 38/42 to accommodate the movement of the scissor arms 30, while minimizing the vertical movement of the mounting member 28 during installation. Bolts 36/40 secure the scissor arms to the mounting member 28, to ensure support arm 14 cannot move relative to the sign's housing once installation is complete. The minimum sign depth compatible with the mounting mechanism is dictated mainly by the sizes of the mounting member 28 and scissor arms 30, and the maximum sign depth compatible with the mounting mechanism 16 is dictated mainly by the length of the adjustment screws 32 (i.e. how far the engagement surfaces 33 can be separated). Thus, a single sized mounting mechanism 16 can be compatible with a very large range of sign depths. Shorter or longer adjustment screws 32 can be swapped in/out of scissor arms 30 to vary the range of compatible sign depths even further.

Once the LED module is affixed to the sign housing using the mounting mechanism, the power supply 18 is electrically connected to the sign's electrical supply. This can be done by hard wiring the power supply 18 to the sign's electrical supply wiring. If space is needed, the sign's conventional fluorescent tube lamp electrical connector 4 may be removed from the sign. Alternately, the power supply 18 can include a power cord that terminates in an electrical connector that is compatible with and connects to the electrical connector 4 already present in the sign, negating the need for any hardwiring.

Figure 5A:
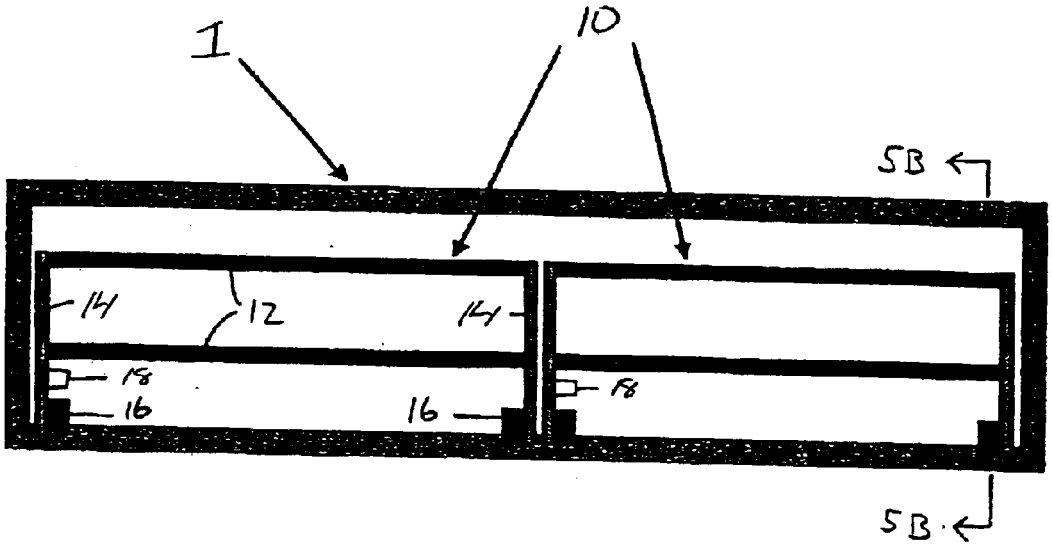
FIG. 5A is a side view of a conventional backlit sign retrofitted with the LED modules of the present invention.
Figure 5B:
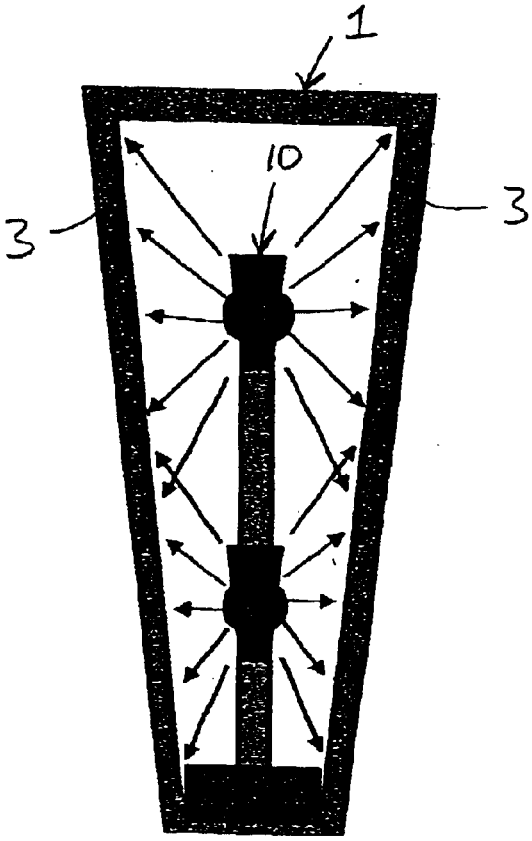
FIG. 5B is an end cross-sectional view of a conventional backlit sign retrofitted with the LED modules of the present invention.

FIGS. 5A and 5B illustrate the LED module of the present invention mounted inside a conventional backlit sign. Two LED modules 10 are placed end to end inside the sign housing 1, although any number and orientation of LED modules 10 can be used depending upon the sign's dimensions and lighting requirements. The pair of LED modules 10 can share a single power supply 18, or each include a dedicated power supply 18 as shown in FIG. 5A. Conventional street name signs typically have a height of about 18 inches, a depth of 6 to 12 inches (typically larger at the top of the sign), and a length of about 4 to 10 feet. Thus, the LED modules 10 of the present invention used to retrofit existing street name signs preferably have a length of 1 to 3 feet, and a height of about 15 inches. The number of LED modules 10 and their dimensions should be such that light from the LEDs brightly and evenly illuminates the entire face plate(s) 3.

Figure 6A:
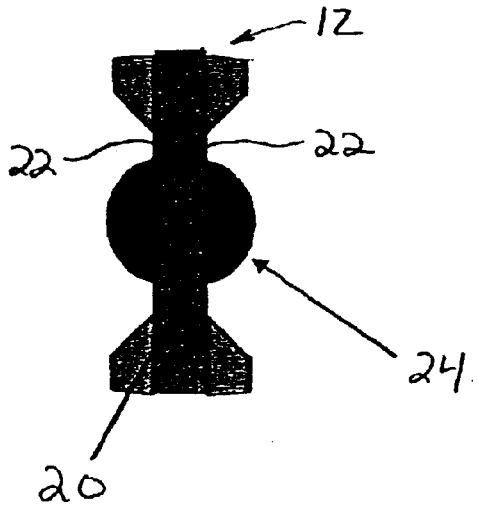
FIG. 6A is an end cross-sectional view of the LED array of the present invention, with parallel mounting surfaces.
Figure 6B:
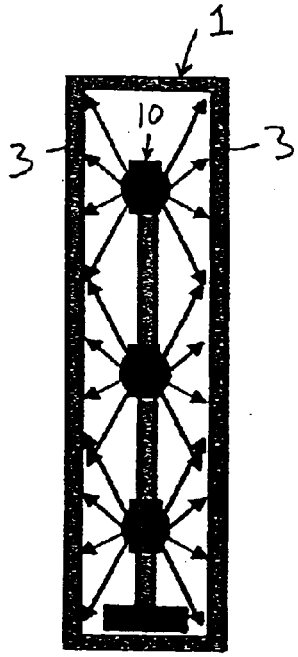
FIG. 6B is an end cross-sectional view of a conventional backlit sign retrofitted with the LED array shown in FIG. 6A.

FIGS. 6A and 6B illustrate the LED module of the present invention mounted inside a commercial double sided backlit sign, where the opposing face plates 3 are parallel to each other. In such a case, the LED array support members 20 each include two mounting surfaces 22 on opposing sides of the support member that are parallel to each other, so the LEDs 24 mounted thereon directly face the opposing translucent face plates 3. Typical backlit commercial signs are 1 to 10 feet in height and length, and 4–12 inches in depth.

Figure 7A:
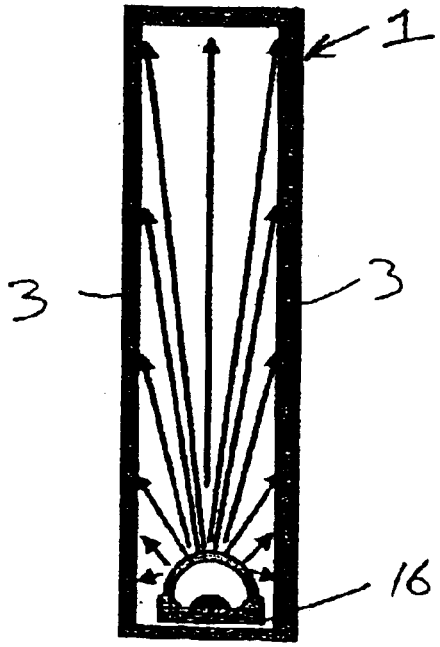
FIG. 7A is an end cross-sectional view of a conventional backlit sign retrofitted with an alternate embodiment of the LED module of the present invention.
Figure 7B:
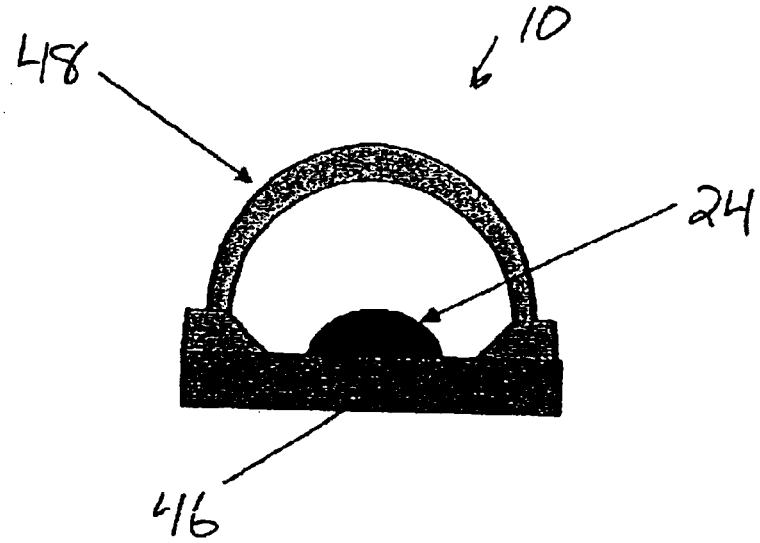
FIG. 7B is an end cross-sectional view of the alternate embodiment of the LED module of the present invention.
Figure 8A:
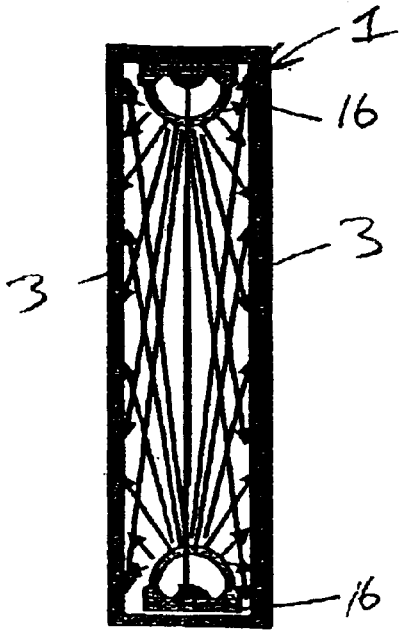
FIG. 8A is an end cross-sectional view of a conventional backlit sign retrofitted with a plurality of the LED module shown in FIG. 7B.
Figure 8B:
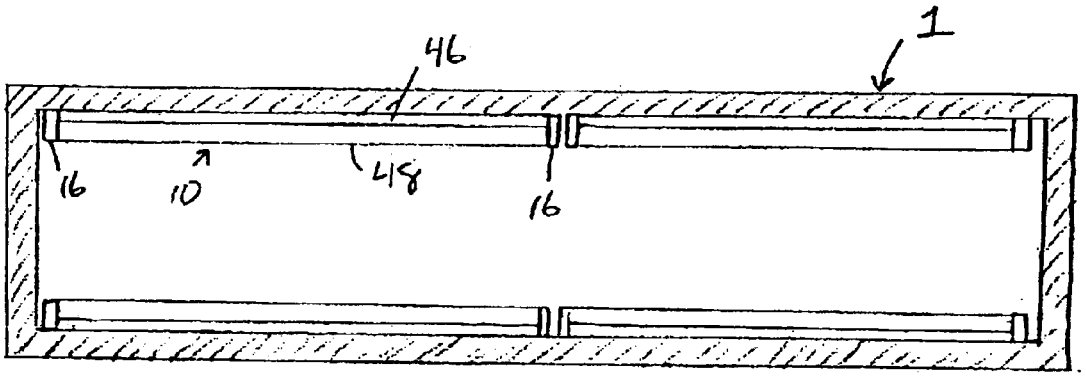
FIG. 8B is a side cross-sectional view of a conventional backlit sign retrofitted with a plurality of the LED module shown in FIG. 7B.

FIGS. 7A and 7B illustrate an alternate embodiment of the LED module 10, where the LEDs 24 are mounted to a base plate 46 (which can act as a heat sink), and an optical lens 48 is disposed over the LEDs 24. This embodiment of LED module 10 is installed along one or more of the sign's interior housing walls, as shown in FIG. 7A. The lens 48 disperses the light from the LEDs to evenly illuminate the sign's translucent face plate(s) 3. Depending on the sign's size and illumination requirements, several LED modules of this type can be installed inside the sign housing, for example along two or more housing sides, as illustrated in FIGS. 8A and 8B. This embodiment is ideal for signs that are subjected to excessive movement or vibrations, as it eliminates the need for long support arms extending from the periphery of the sign's housing.

There are numerous advantages of the present invention. The LED modules of the present invention can be easily and quickly installed into conventional backlit signs, often requiring nothing more than just a screw driver. A single LED module is compatible with a very wide range of sign depths. The installed LED modules will not become loose within the sign housing over time, even with sign movement or vibration.

It is to be understood that the present invention is not limited to the embodiment(s) described above and illustrated herein, but encompasses any and all variations falling within the scope of the appended claims. For example, support member 20 could be two separate support members mounted back to back, or a composite structure that includes one or more PC boards mounted together or to a rigid material. Bolts 36/40 can be any rigid member (e.g. pins, rivets, etc.) that can slidably attach the scissor arms 30 to the mounting member 28 via slots 38/42. Only some (or even none) of the scissor arm lower portions may include the adjustment screws 32, in which case some (or even all) of the engagement surfaces may be on or attached to the scissor arm lower portions themselves (e.g. its outer side surface). Bolts 40 could extend from portions of scissor arms 30 above mid-portion 30*b* (and bolt 36), instead of below mid-portion 30*b* as shown in FIG. 4, if raising or lowering the height of the engagement surfaces relative to the mounting member 28 is not problematic. The power supply 18 could be incorporated inside the support member 20, so that each LED array 12 has its own power supply 18. The number of LED arrays 12 for each module 10, and the number and orientation of modules 10 in each sign, can vary to meet the lighting requirements of the sign. Lastly, for the purposes of this disclosure, references to a translucent face plate (sidewall) includes face plates (sidewalls) having portions that transmit light, with or without any diffusion, with or without any color filtering, and with or without opaque portions that form designs or characters.

What is claimed is:

1. An LED module, comprising:

a first support member having a first mounting surface;

a first plurality of LEDs mounted to the first mounting surface;

first and second support arms attached to the first support member;

a first mounting mechanism attached to the first support arm;

a second mounting mechanism attached to the second support arm;

each of the first and second mounting mechanisms include:

first and second scissor arms each having an upper portion, a lower portion and a mid portion therebetween, wherein the mid portions of the first and second scissor arms are rotatably connected together and each of the lower portions includes an engagement surface; and a first screw engaged with the first and second scissor arm upper portions for adjusting a distance therebetween and a separation distance between the engagement surfaces of the first and second scissor arm lower portions.

2. The LED module of claim 1, wherein for each of the first and second mounting mechanisms, at least one of the scissor arm lower portions comprises a second screw that is threaded therethrough and that includes one of the engagement surfaces such that rotating the second screw varies the separation distance between the engagement surfaces.

3. The LED module of claim 1, wherein for each of the first and second mounting mechanisms, each of the scissor arm lower portions comprises a second screw that is threaded therethrough and that includes one of the engagement surfaces such that rotating each of the second screws varies the separation distance between the engagement surfaces.

4. The LED module of claim 2, wherein each of the second screws includes an engagement block of material that terminates with one of the engagement surfaces and is conducive to forming a friction fit.

5. The LED module of claim 1, wherein each of the first and second support arms includes a mounting member having first, second and third slots, and wherein each of the first and second mounting mechanisms further comprises:

a first bolt for connecting the first and second scissor arms mid portions together in a rotatable manner and to the first slot in a slidable manner.

6. The LED module of claim 5, wherein each of the first and second mounting mechanisms further comprises:

a second bolt extending from the first scissor arm and slidably connected to the second slot; and a third bold extending from the second scissor arm and slidably connected to the third slot.

7. The LED module of claim 6, wherein for each of the mounting members, the first slot extends in a direction perpendicular to that of the second and third slots.

8. The LED module of claim 7, wherein the first slots extend in a direction parallel to that of the first and second support arms.

9. The LED module of claim 1, wherein the first support member further includes a second mounting surface and a second plurality of LEDs mounted to the second mounting surface, and wherein the first and second mounting surfaces are substantially parallel to each other and face in opposite directions relative to each other.

10. The LED module of claim 1, wherein the first support member further includes a second mounting surface and a second plurality of LEDs mounted to the second mounting surface, and wherein the first and second mounting surfaces generally face in opposite directions but are not parallel to each other.

11. The LED module of claim 1, further comprising:

a second support member having a second mounting surface and attached to the first and second support arms;

a second plurality of LEDs mounted to the second mounting surface.

12. The LED module of claim 11, wherein:

the first support member further includes a third mounting surface and a third plurality of LEDs mounted to the third mounting surface; and the second support member further includes a fourth mounting surface and a fourth plurality of LEDs mounted to the fourth mounting surface.

13. The LED module of claim 12, wherein the first and third mounting surfaces are substantially parallel to each other and face in opposite directions relative to each other, and wherein the second and fourth mounting surfaces are substantially parallel to each other and face in opposite directions relative to each other.

14. The LED module of claim 12, wherein the first and third mounting surfaces generally face in opposite directions but are not parallel to each other, and wherein the second and fourth mounting surfaces generally face in opposite directions but are not parallel to each other.

15. A backlit sign, comprising:

a housing having first and second side walls, wherein at least a portion of the first sidewall is translucent;

a first support member disposed in the housing and having a first mounting surface facing the first sidewall;

a first plurality of LEDs mounted to the first mounting surface for illuminating the first sidewall;

first and second support arms attached to the first support member;

a first mounting mechanism attached to the first support arm;

a second mounting mechanism attached to the second support arm;

each of the first and second mounting mechanisms include:

first and second scissor arms each having an upper portion, a lower portion and a mid portion therebetween, wherein the mid portions of the first and second scissor arms are rotatably connected together and each of the lower portions includes an engagement surface that is pressed against one of the first and second sidewalls to form a friction fit therewith; and a first screw engaged with the first and second scissor arm upper portions for adjusting a distance therebetween and a separation distance between the engagement surfaces of the first and second scissor arm lower portions to increase or decrease a force with which the engagement surfaces are pressed against the sidewalls.

16. The sign of claim 15, wherein for each of the first and second mounting mechanisms, at least one of the scissor arm lower portions comprises a second screw that is threaded therethrough and that includes one of the engagement surfaces such that rotating the second screw varies the separation distance between the engagement surfaces.

17. The sign of claim 15, wherein for each of the first and second mounting mechanisms, each of the scissor arm lower portions comprises a second screw that is threaded therethrough and that includes one of the engagement surfaces such that rotating each of the second screws varies the separation distance between the engagement surfaces.

18. The sign of claim 16, wherein each of the second screws includes an engagement block of material that terminates with one of the engagement surfaces and is conducive to forming the friction fit with one of the sidewalls.

19. The sign of claim 15, wherein each of the first and second support arms includes a mounting member having first, second and third slots, and wherein each of the first and second mounting mechanisms further comprises:

a first bolt for connecting the first and second scissor arms mid portions together in a rotatable manner and to the first slot in a slidable manner.

20. The sign of claim 19, wherein each of the first and second mounting mechanisms further comprises:

a second bolt extending from the first scissor arm and slidably connected to the second slot; and a third bold extending from the second scissor arm and slidably connected to the third slot.

21. The sign of claim 20, wherein for each of the mounting members, the first slot extends in a direction perpendicular to that of the second and third slots.

22. The sign of claim 21, wherein the first slots extend in a direction parallel to that of the first and second support arms.

23. The sign of claim 15, wherein:

at least a portion of the second sidewall is translucent;

the first support member further includes a second mounting surface facing the second sidewall and a second plurality of LEDs mounted to the second mounting surface for illuminating the second sidewall; and the first and second mounting surfaces are substantially parallel to each other and face in opposite directions relative to each other.

24. The sign of claim 15, wherein:

at least a portion of the second sidewall is translucent;

the first support member further includes a second mounting surface facing the second sidewall and a second plurality of LEDs mounted to the second mounting surface for illuminating the second sidewall; and the first and second mounting surfaces generally face in opposite directions but are not parallel to each other.

25. The sign of claim 15, further comprising:

a second support member having a second mounting surface facing the first sidewall and attached to the first and second support arms;

a second plurality of LEDs mounted to the second mounting surface for illuminating the first sidewall.

26. The sign of claim 25, wherein:

at least a portion of the second sidewall is translucent;

the first support member further includes a third mounting surface facing the second sidewall and a third plurality of LEDs mounted to the third mounting surface for illuminating the second sidewall; and the second support member further includes a fourth mounting surface facing the second sidewall and a fourth plurality of LEDs mounted to the fourth mounting surface for illuminating the second sidewall.

27. The sign of claim 26, wherein the first and third mounting surfaces are substantially parallel to each other and face in opposite directions relative to each other, and wherein the second and fourth mounting surfaces are substantially parallel to each other and face in opposite directions relative to each other.

28. The sign of claim 26, wherein the first and third mounting surfaces generally face in opposite directions but are not parallel to each other, and wherein the second and fourth mounting surfaces generally face in opposite directions but are not parallel to each other.

29. A method of retrofitting a backlit sign having a housing with first and second sidewalls, and a light source disposed inside a housing, wherein at least a portion of the first sidewall is translucent, the method comprising:

removing the light source from the housing;

inserting an LED module into the housing, the LED module including:

a first support member disposed in the housing and having a first mounting surface, a first plurality of LEDs mounted to the first mounting surface for illuminating the first sidewall, first and second support arms attached to the first support member, a first mounting mechanism attached to the first support arm, a second mounting mechanism attached to the second support arm, and each of the first and second mounting mechanisms include:

first and second scissor arms each having an upper portion, a lower portion and a mid portion therebetween, wherein the mid portions of the first and second scissor arms are rotatably connected together and each of the lower portions includes an engagement surface, and a first screw engaged with the first and second scissor arm upper portions for adjusting a distance therebetween and a separation distance between the engagement surfaces of the first and second scissor arm lower portions; and rotating the first screw to press the engagement surfaces against the first and second sidewalls to form a friction fit therewith for securing the LED module within the housing.

30. The method of claim 29, wherein for each of the first and second mounting mechanisms, at least one of the scissor arm lower portions comprises a second screw that is threaded therethrough and that includes one of the engagement surfaces such that rotating the second screw varies the separation distance between the engagement surfaces, the method further comprising:

rotating the second screws such that for each of the mounting mechanisms, the separation distance between the engagement surfaces is less than a distance between the first and second sidewalls to facilitate the insertion of the LED module into the housing.

31. The method of claim 29, wherein for each of the first and second mounting mechanisms, each of the scissor arm lower portions comprises a second screw that is threaded therethrough and that includes one of the engagement surfaces such that rotating each of the second screws varies the separation distance between the engagement surfaces, the method further comprising:

rotating the second screws such that for each of the mounting mechanisms, the separation distance between the engagement surfaces is less than a distance between the first and second sidewalls to facilitate the insertion of the LED module into the housing.

32. The method of claim 29, wherein:

each of the first and second support arms includes a mounting member having first, second and third slots;

each of the first and second mounting mechanisms further comprises:

a first bolt for connecting the first and second scissor arms mid portions together in a rotatable manner and to the first slot in a slidable manner, a second bolt extending from the first scissor arm and slidably connected to the second slot, and a third bold extending from the second scissor arm and slidably connected to the third slot;

during the rotation of the first screw, the first, second and third bolts slide in the first, second and third slots respectively.

* * * * *